United States Patent [19]

Miyoshi et al.

[11] 4,008,103

[45] Feb. 15, 1977

[54] PROCESS FOR THE MANUFACTURE OF STRONG TOUGH STEEL PLATES

[75] Inventors: Eiji Miyoshi, Nishinomiya; Minoru Fukuda, Itami; Yasuhiko Hagiwara, Wakayama; Yasuhiro Asai, Ibaragi, all of Japan

[73] Assignee: Sumitomo Metal Industries, Ltd., Japan

[22] Filed: Sept. 17, 1975

[21] Appl. No.: 613,996

Related U.S. Application Data

[63] Continuation of Ser. No. 408,950, Oct. 23, 1973, abandoned, which is a continuation-in-part of Ser. No. 144,534, May 18, 1971, abandoned.

[30] Foreign Application Priority Data

| | | |
|---|---|---|
| May 20, 1970 | Japan | 45-43563 |
| May 25, 1970 | Japan | 45-45021 |
| June 11, 1970 | Japan | 45-50898 |
| July 1, 1970 | Japan | 45-58009 |
| Sept. 19, 1970 | Japan | 45-82373 |
| Sept. 19, 1970 | Japan | 45-82374 |

[52] U.S. Cl. ..... 148/12 F

[51] Int. Cl.[2] ..... C21D 7/14

[58] Field of Search ..... 148/12 F

[56] References Cited

UNITED STATES PATENTS

| | | | |
|---|---|---|---|
| 3,806,378 | 4/1974 | Bramfitt et al. | 148/12 F |

FOREIGN PATENTS OR APPLICATIONS

| | | | |
|---|---|---|---|
| 768,590 | 10/1967 | Canada | 148/12 F |
| 1,188,574 | 4/1970 | United Kingdom | 148/12 F |

*Primary Examiner*—W. Stallard

[57] ABSTRACT

Strong and tough steel is prepared by heating to a temperature of 800° – 1000° C., preferably from 800° to 950° C., before the rolling step, finish rolling at temperatures within the range of from 680° to 850° C., preferably from 680° to 800° C. and with a reduction ratio in thickness of not less than 30% based on the plate thickness of the steel when the finish rolling is started. It is advantageous to provide for a pretreatment of the steel, said pretreatment including the steps of initially heating the steel to a temperature higher than 1000° C., rolling the heated steel to a suitable intermediate thickness and cooling the rolled steel to a temperature lower than 650° C.

Tempering may also be carried out at a temperature of 500° – 650° C. for 20 minutes — 2 hours.

14 Claims, 5 Drawing Figures

THE MECHANICAL PROPERTIES OF LOW CARBON STRUCTURAL STEELS

THE MECHANICAL PROPERTIES OF LOW CARBON STRUCTURAL STEELS

PROCESS FOR THE MANUFACTURE OF STRONG TOUGH STEEL PLATES

This is a continuation of application Ser. No. 408,950, filed Oct. 23, 1973 and now abandoned, which in turn is a continuation-in-part of application Ser. No. 144,534 filed May 18, 1971, and now abandoned.

This invention relates to a process for the manufacture of strong and tough steel plates having an improved low temperature toughness in the as-rolled condition.

Conventional high strength untempered steel plates for service at low temperatures are classified generally into two kinds, namely (a) as-rolled steels and (b) as-normalized steels. Steels (a) are excellent in mechanical strength with respect to their low contents of alloying elements. Steels (b) are characterized by excellent low temperature toughness and homogeneity in quality. Each of steels (a) and (b), however, has the following defects.

In general, steels (a) are inferior in low temperature toughness and homogeneity in quality. In view of these defects, it has been proposed that rolling be conducted with relatively low finishing temperature by a method called the "controlled rolling method". But, even in this method, a limit is imposed on the degree of the improvement in the low temperature toughness as described in detail hereinafter.

Steels (b) are generally inferior in mechanical strength. When there is desired a tensile strength higher than 55kg/mm$^2$ and a yield strength higher than 40kg/mm$^2$, steels (b) require relatively large amounts of alloying elements. However, such inclusion of large amount of alloying elements tends to degrade the low temperature toughness.

The foregoing can also be readily seen from the FIG. 13 on page 8 of the commentary of K.J. Irvine on the developement of strong tough steels (Strong Tough Structural Steels: Proceeding of Joint Conference Organized by British Iron and Steel Reserch Association and the Iron and Steel Institute, 4–6, April 1967). This FIGURE is appended to the instant specification as FIG. 1. From this FIGURE, it is seen that the low temperature impact properties of untempered steels are, in the most excellent cases, a yield strength of 40kg/mm$^2$ and a ductile-brittle transition temperature of −90° C; a yield stress of 45kg/mm$^2$ and a ductile-brittle transition temperature of −65° C; a yield stress of 50kg/mm$^2$ and a ductile-brittle transition temperature of −50° C; and a yield stress of 60kg/mm$^2$ and a ductile-brittle transition temperature of −30° C.

The conventional controlled rolling methods are conducted by heating the steel to a temperature of from about 1200° to 1350° C. and rolling the heated steel at temperatures within the range from the temperature in the vicinity of the heating temperature to about 800° C. The heating temperature is in some cases, for example, in the method disclosed in the U.S. Pat. No. 3,328,211 of Nakamura, within the range of from 1100° to 1200° C. This relatively low heating temperature results in the refinement of austenite crystal grain of the steel to be rolled and serves to improve the impact property. As will be explained in the Examples, however, the low temperature toughness and the homogeneity in the quality of the resulting steel are not yet satisfactory. In general, low heating temperature, for instance, lower than 1100° C., has not been employed, because it has been considered that such low heating temperature would decrease the processing efficiency of the rolling process and at the same time degrade the homogeneity of the steel.

It is an object of the present invention to provide a method by which a high strength steel plate having a good combination of strength and low temperature toughness in the as-rolled condition.

It is another object of the present invention to provide a pretreatment of the steel, which is preferably conducted in advance of the process of the rolling method of the present invention.

It is a further object of the present invention to provide a tempering process, which is preferably conducted subsequently to the rolling method of the present invention.

Other objects and advantages of the present invention will be apparent from the following description.

In accordance with the present invention, there is provided a new method for the manufacture of strong and tough steels, which method is characterized in that the steel is heated to a heating temperature of from 800° to 1000° C., preferably from 800° to 950° C., before the rolling step and that a finish rolling is conducted at temperatures within the range of from 680° to 850° C., preferably from 680° to 800° C. and with a reduction ratio in thickness of not less than 30% based on the plate thickness of the steel when the finish rolling is started. In the method of the present invention, rough rolling or intermediate rolling may be conducted. But, it is essential to the present invention to conduct finish rolling at temperatures ranging from 680° to 850° C. with a reduction ratio in thickness of not less than 30%. The term "finish rolling" used herein means a rolling process conducted for the purpose of adjusting the final dimension and configuration of the steel plate, and particularly in the rolling method of the present invention, for conferring toughness and strength to the steel plate. The finish rolling may be conducted by a single pass or several passes through a finishing mill, or by a tandem mill consisting of several finishing mills. In the finish rolling step, therefore, there is observed a temperature gradient of from the starting temperature of the finish rolling to the final temperature of the same. In the instant specification, the starting temperature of the finish rolling means the inlet temperature of the first pass of the finish rolling, and the final temperature of the finish rolling means the inlet temperature of the final pass of the finish rolling.

In accordance with an embodiment of the present invention, there is provided a pretreatment of the steel, said pretreatment including the steps of initially heating the steel to a temperature higher than 1000° C., rolling the heated steel to a suitable intermediate thickness and cooling the rolled steel to a temperature lower than 650° C. to provide a steel plate to be subjected to the rolling method of the present invention.

According to another embodiment of the present invention, the as-rolled steel plate is subsequently tempered by heating the finish rolled steel plate at a temperature of from 500° to 650° C. for a time duration of from 20 minutes to 2 hours and then cooling the heated steel plate to room temperature.

With respect to the chemical composition, it is necessary that the steel material to be subjected to the rolling method of the present invention should have a basic composition of 0.03 to 0.30% of carbon, not more than 1.5% of silicon, 0.50 to 4.00% of manganese and the balance essentially of iron.

The reasons for limitation on the chemical composition of the steel are as follows:

At a carbon content of less than 0.03%, the resulting steel plate is inferior in strength and the manufacturing cost is expensive. At a carbon content exceeding 0.30%, the weldability of the product steel plate is poor. Although silicon is an element necessary for deoxidizing and improvement of the strengh, when its content exceeds 1.5%, the weldability of the product steel plate is degraded. At a manganese content of less than 0.5%, good results are not obtained in respect to hot working applicability and strength, and at a manganese content of greater than 4.0%, the weldability of the product steel plate is reduced with increase of the manufacturing cost.

In this invention, in order to improve the strength of the product, it is possible to incorporate into a steel material of the above composition one or more so-called precipitation hardening elements such as vanadium, niobium, titanium and molybdenum. Thus, there is attained an advantage that the strength can be highly improved while the toughness is hardly reduced. As is seen from FIG. 1, the improvement of the strength generally results in decrease of low temperature toughness and sharp increase of ductile-brittle transition temperature. However, in this invention, when one or more precipitation hardening elements indicated in Table 1 are contained in the starting steel material in amounts indicated in Table 1, it is possible to improve the strength of the product without increase of ductile-brittle transition temperature.

TABLE 1

| Precipitation Hardening Elements | Contents (%) |
|---|---|
| V (vanadium) | 0.02 – 0.30 |
| Nb (niobium) | 0.005 – 0.20 |
| Ti (titanium) | 0.03 – 0.20 |
| Mo (molybdenum) | 0.05 – 1.0 |
| Zr (zirconium) | 0.02 – 0.20 |
| Ta (tantalum) | 0.010 – 0.10 |

In case the contents of precipitation hardening elements are outside the ranges specified in Table 1, the intended object of this invention can not be accomplished, and the desired strength and toughness can not be obtained. Further, when the contents of these elements exceed the upper limits, undesired increase of the manufacturing cost is inevitably brought about.

When a steel material containing one or more of such precipitation hardening elements at contents specified in Table 1 is processed according to this invention, there can be obtained an unquenched, strong, tough steel plate excellent in both strength and toughness, for instance, having a combination of yield stress higher than 42kg/mm² and a ductile-brittle transition temperature lower than −60° C.

When a high mechanical strength is required such as a tensile strength exceeding 65kg/mm² and yield stress exceeding 60kg/mm², the starting steel material may contain one or more of hardenability-improving elements as shown in Table 2.

TABLE 2

| Elements | Content Ranges (%) |
|---|---|
| Manganese | 8 – 4.0 |
| Chromium | 0 – 3.0 |

TABLE 2-continued

| Elements | Content Ranges (%) |
|---|---|
| Molybdenum | 0.15 – 1.0 |
| Boron | 0.002 – 0.01 |
| Silicon | 0.9 – 1.5 |

Furthermore, when properties other than those described above, such as corrosion resistance, weathering resistance and resistance to marine corrosion, are required, as is frequently in high strength steels, the starting steel material may contain one or more of nickel (0.2 to 2.0%), chromium (0.2 to 3.0%), copper (0.2 to 1.0%) and other elements usually employed for improving the above properties.

When the steel is intended for use in service at low temperatures, such as pipe line and storage tank for liquid natural gas, it is preferable that the starting steel material contains 0.5 to 5.0% of nickel.

The present invention will be explained in more detail by way of Examples and with reference to the accompanying drawings, wherein.

EXAMPLE 1

Steel Samples 1 to III, each being a plate of 22mm in thickness and having respectively the chemical compositions as shown in Table 3, were prepared.

TABLE 3

| Elements (%) | Sample I | Sample II | Sample III |
|---|---|---|---|
| Carbon | 0.15 | 0.16 | 0.12 |
| Silicon | 0.41 | 0.28 | 0.33 |
| Manganese | 1.41 | 1.18 | 1.34 |
| Vanadium | — | 0.07 | — |
| Niobium | — | — | 0.03 |

Each Samples I, II, III was heated to temperatures of 750° C., 800° C., 900° C., 1000° C., 1050° C. and 1100° C., respectively and then finish rolled from the initial thickness of 22mm to a final thickness of 11mm. In the case of the heating temperature of 750° C., finish rolling was conducted at a starting temperature of 750° C. and a final temperature of 700° C. and a final temperature of 700° C. In the other cases, the finish rolling was conducted with a starting temperature of 800° C. and a final temperature of 700° C. Relationships between heating temperatures and Charpy fracture appearance transition temperatures (2-mm V-notch) of the resulting steel plates are plotted in FIG. 2.

In accordance with this invention, heating of the steel is effected at a temperature of from 800° to 1000° C., preferably from 800° to 950° C. In case the heating is effected at a temperature lower than 800° C., the homogeneity of the rolled structure and properties of the product steel plate is hindered, with the result that the low temperature toughness abruptly decreases. In case the heating is effected at a temperature higher than 1000° C., the grain refining effect, which will be explained hereinafter in detail, cannot effectively be attained by the subsequent finish rolling step. Thus, the improvement of low temperature toughness cannot be made and the resulting steel plate sometimes becomes of a duplex structure. Namely, in the method of this invention, it is essential that both the heating and the finish rolling be conducted under the above mentioned conditions.

Figure 1:
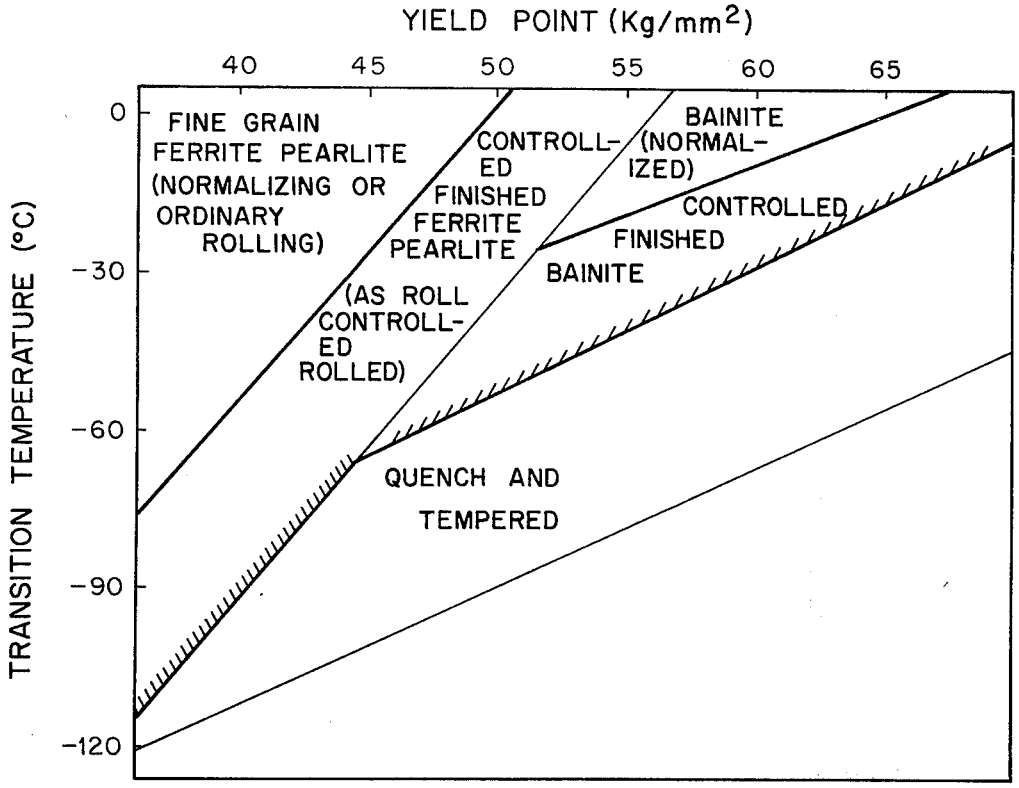
FIG. 1 illustrates the relationship between the trasition temperature (° C.) and the yield point (kg/mm²) of various structural steels.
Figure 2:
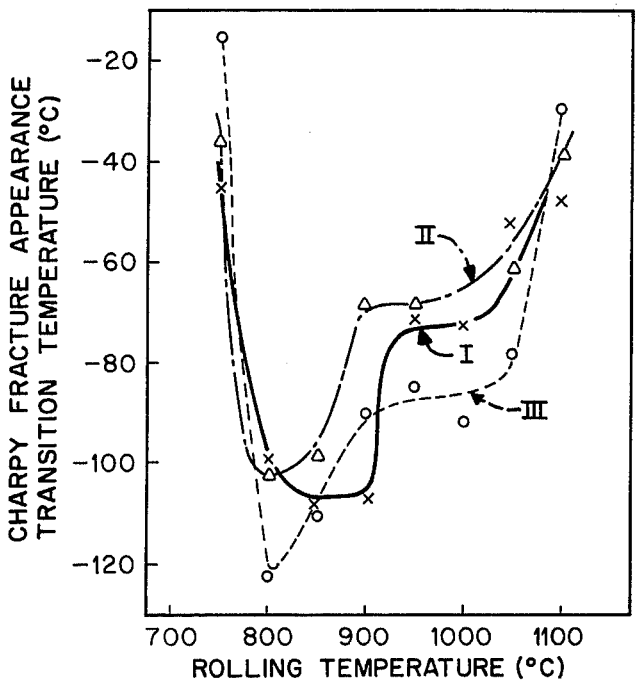
FIG. 2 illustrates graphically the relationship between the heating temperature (° C) and the Charpy fracture appearance transition temperature (° C) for different steels.

As is readily appreciated from FIG. 2, the improvement in low temperature fracture toughness is attained in two stages with respect to the heating temperature, one at a temperature range of from about 950° to about 1000° C., and the other at the temperature range of from about 800° to about 950° C. The cause of this difference in the improvement of low temperature toughness is considered that at a lower heating temperature the austenite crystal grain size tends to become finer and moreover that this effect is amplified with the effect of finish rolling at low temperatures. From the results shown in FIG. 2 it is evident that especially when the heating is effected at a temperature within the range of about 800°–950° C, there can be obtained a product having an excellent ductile-brittle transition temperature from −60° to −120° C, which is hardly attainable in conventional untempered steel products of low alloy element contents.

EXAMPLE 2

Sample IV having a composition; C 0.11%, Si 0.28%, Mn 1.23%, V 0.07%, Cu 0.16%, Cr 0.27% and the balance substantially of iron, were processed following to the rolling schedules shown in Table 4. In Table 4, methods B and C were conducted continuously respectively from 1000° C and 1100° C to 790° C.

TABLE 4

| Rolling Condition | Method A | Method B | Method C |
|---|---|---|---|
| Heating Temperature (° C) | 920 | 1100 | 1200 |
| initial thickness (mm) | 40 | 120 | 220 |
| plate thickness (mm) | 14 | 14 | 14 |
| rough rolling Temperature (° C) | 920 – 850 | 1000° C ~ | 1100° C ~ |
| reduction (%) | 49 (40 → 20.3 mm) | | |
| finish rolling (° C) starting temperature (° C) | 800 (3 passes) | | |
| final temperature (%) | 750 | 790° C | 790° C |
| reduction | 31 (20³ – 14)*** | (Total 88) | (Total 94) |

*continuously rolling

Method A falls within the scope of the present invention. Methods B and C are the conventional controlled rolling method. Resulting steel plates obtained by Methods A, B and C were subjected to the temperature gradient type double tension test, and with respect to each plate the critical brittle fracture stress was determined. The results are illustrated in Table 5 and plotted in FIG. 3.

Figure 3:
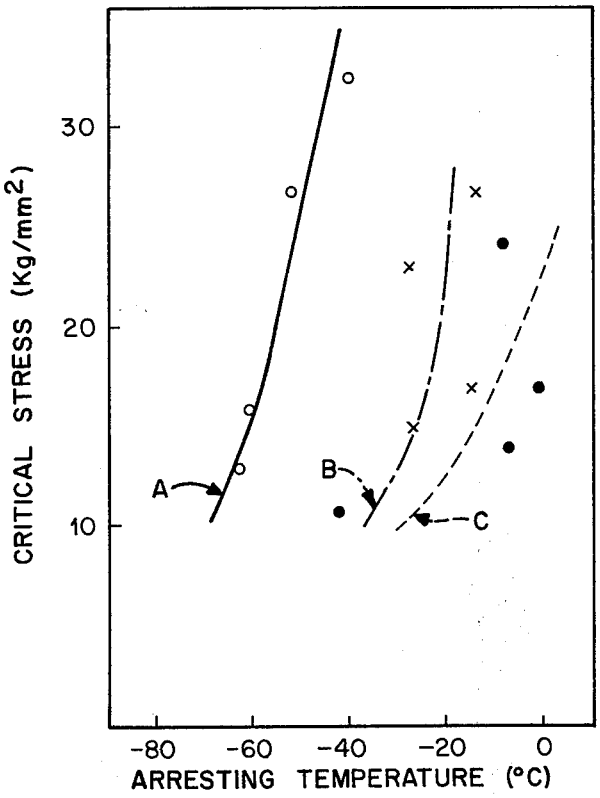
FIG. 3 illustrates graphically the relationship between the critical brittle fracture stress (kg/mm²) and the arresting temperature for steels obtained by different methods.

From FIG. 3 it is seen that the steel A processed in accordance with the method of this invention has an excellent low temperature toughness, and moreover, in the steel A, deviations of test results were extremely low as compared with the cases of steels B and C. Accordingly, it can be readily understood that the product according to this invention is excellent also in homogeneity of quality.

TABLE 5

| Mechanical Properties | Method A | Method B | Method C |
|---|---|---|---|
| Tensile Strength (kg/mm²) | 55.3 | 51.9 | 51.7 |
| Yield Stress (kg/mm²) | 42.2 | 40.6 | 40.4 |
| Total Elongation (%) | 36.5 | 39.0 | 41.0 |
| Charpy Fracture Appearance Transition Temperature (° C) | − 86 | − 54 | − 28 |
| Impact Absorbed Energy at − 40° C, in Transverse Direction (kg-m) | 4.8 | 5.6 | 2.7 |

As is understood from FIG. 3, with the lower heating temperature, the improvement of low temperature toughness of the product is more prominent in the conventional controlled rolling method. It is believed that in the conventional rolling method lower heating temperature is employed because mechanical properties of the rolled steel plate are improved by controlling the austenite grain size of the steel to be rolled. In other words, with higher heating temperature, austenite crystal grain of the steel to be rolled becomes more coarse with the result that the resulting steel plate becomes poor in low temperature toughness. However, the present invention is based on the idea that low temperature toughness depends on different factors, and that the improvement is attained by the crystal refinement owing to plastic deformation of the crystal grain of the steel in the course of finish rolling process. More specifically, under the rolling conditions of the present invention, the austenite crystal grain of the steel is fractured finely during the finish rolling process and at the same time the austenite transforms into ferrite whereby the crystal grain of ferrite is produced in a highly refined form and uniformly throughout the thickness of the steel plates. This effect becomes prominent when the heating temperature is lower than 950° C. and finish rolling is conducted at a starting temperature lower than 800° C.

In order to ensure the above effect, finish rolling should be conducted at a finish rolling temperature ranging from 680° to 850° C. and also with a reduction ratio in thickness of not less than 30%. The lower limit of the reduction in thickness during finish rolling is determined to ensure the uniform fracture of the crystal grain throughout the thickness of the steel plate. When a reduction in thickness of at least 30% is not effected within the temperature range of from 680° to 850° C. but at temperatures higher than 850° C., the plastic deformation of the austenite grain of the steel proceeds extremely earlier than the transformation of austenite into ferrite and the once fractured austenite grain of the steel recoverys and grows in the course of cooling of the rolled steel plate after the rolling, so that the effect attained by the fracture of the crystal grain becomes lesser. On the other hand, when a reduction in thickness of at least 30% is not effected within the temperature range of from 680° to 850° C. but at temperatures lower than 680° C., the transformation of austenite to ferrite proceeds much earlier than the plastic deformation of grain and as such, the ferrite grain thus formed suffers the work hardening effect in the course of finish rolling with the result that the resulting steel plate becomes poor in toughness.

Thus, in accordance with the present invention, the heating temperature and the rolling conditions are related to one another so that the combination of the heating temperature and the rolling conditions enables the manufacture of steel plates having excellent properties that would otherwise be obtainable.

EXAMPLE 3

Steel Samples V and VI, of which compositions are shown in Table 6, were heated at temperatures of (1) 950° C. and (2) 850° C., and then rolled at a final temperature of the finish rolling varying from 650° to 950° C., with a view of examining the effect thereof on the properties of the resulting steel plates.

TABLE 6

| Element Content (%) | Sample Steel V | Sample Steel VI |
|---|---|---|
| Carbon | 0.16 | 0.15 |
| Silicon | 0.32 | 0.27 |
| Manganese | 1.16 | 1.26 |
| Phosphorus | 0.015 | 0.016 |
| Sulfur | 0.017 | 0.016 |
| Vanadium | — | 0.09 |

Each of the above Steel Samples was heated to a temperature of (1) 950° C. or (2) 850° C., and then rough rolled at a temperature in the vicinity of each heating temperature with a reduction in thickness of 23% that is, from an initial thickness of 22mm to an intermediate thickness of 17mm. Each of the rough rolled Steel Samples was finish rolled with a reduction in thickness of 35%, that is, from an intermediate thickness of 17mm to a final thickness of 11mm, and respectively at a final temperature of 650°, 700°, 750°, 800°, 850° or 900° C. Each finish rolling was conducted by 2-pass rolling and respectively at a starting temperature higher by about 30° C than the corresponding final temperature mentioned above.

Figure 4:
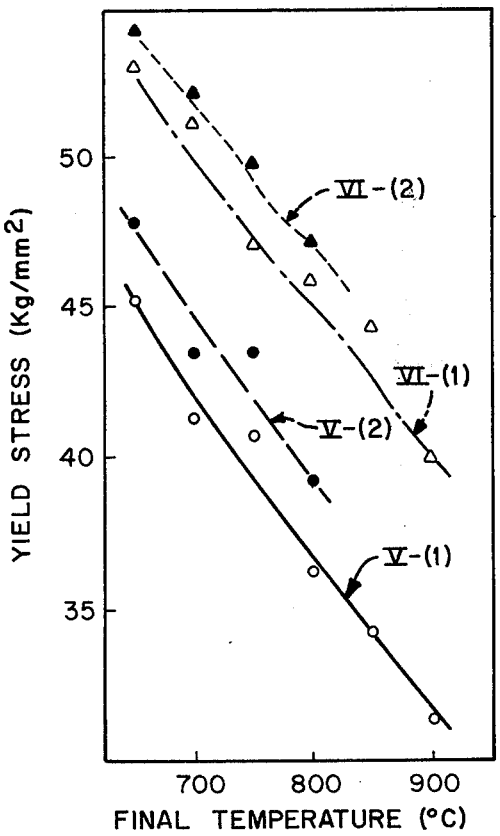
FIG. 4 illustrates graphically the relationship between the yield stress (kg/mm²) and the final temperature (° C) of finish rolling of steel Samples V and VI.
Figure 5:
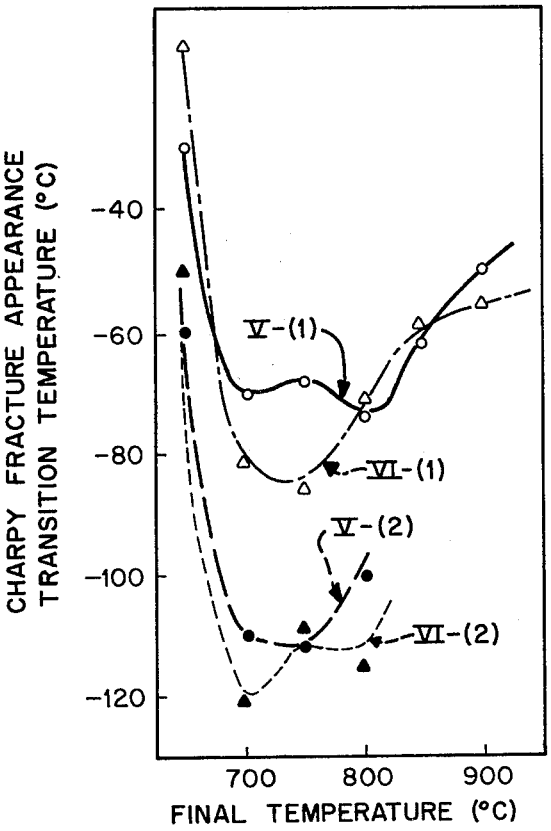
FIG. 5 illustrates graphically the relationship between the Charpy fracture appearance transistion temperature (° C) and the final temperature (° C) of finish rolling of steel Samples V and VI.

The yield stress and Charpy fracture appearance transition temperature of each finish rolled Steel Sample are plotted in FIGS. 4 and 5.

As seen from FIGS. 4 and 5, the toughness and strength are prominently improved with the decrease of the roll finishing temperature, but the toughness is abruptly lowered when finish rolling is conducted at a final temperature lower than 680° C. Thus, it is seen that in order to obtain a product prominently excellent both in strength and toughness it is necessary to conduct the finish rolling at temperatures of 680°–850° C.

From these Figures it is also seen that although a rolled product from sample steel VI containing 0.09% of vanadium as precipitation hardening element exhibits a strength highly improved over the rolled product from steel sample V which is free of vanadium, it does not show any degradation of toughness but it is very excellent strong tough steel plate having a yield stress of 55kg/mm² and ductile-brittle transition temperature of −80° to −120° C.

EXAMPLE 4

Steel samples VII, VIII, IX, X and XI shown in Table 7 were treated by the method of this invention, the conventional controlled rolling method and the conventional normalizing method. Mechanical properties of product steel plates as well as rolling schedules are shown in Tables 8 and 9.

From the results shown in Table 9, it is seen that when the method of this invention is applied to either a killed steel or a semi-killed steel, the method of this invention can attain an excellent effect of improving mechanical properties of the product steel plate, especially the toughness thereof, over the conventional controlled rolling method and normalizing method.

From the results shown in Table 9 it is also seen that the toughness-improving effect according to this invention is very prominent in the case of a thick plate having such a thickness as 30 – 40mm as well as in the case of a plate of a thickness of less than 20mm, and that the starting steel material containing vanadium, niobium or molybdenum can be treated according to this invention to form a steel plate prominently excellent in not only toughness but also strength.

TABLE 7

| Element Contents (%) | Steel Sample Nos. VII (semi-killed) | VIII (semi-killed) | IX (killed) | X (killed) | XI (killed) |
|---|---|---|---|---|---|
| C | 0.18 | 0.15 | 0.16 | 0.08 | 0.14 |
| Si | 0.11 | 0.13 | 0.45 | 0.31 | 0.31 |
| Mn | 0.72 | 1.01 | 1.46 | 1.32 | 1.26 |
| V | — | — | — | 0.08 | 0.06 |
| Nb | — | 0.027 | — | 0.03 | — |
| Sol. Al | — | — | 0.017 | 0.025 | 0.027 |
| Mo | — | — | — | — | 0.13 |

TABLE 8

| | | Manufacturing Conditions | | | | | | | | |
|---|---|---|---|---|---|---|---|---|---|---|
| | | | | | rough rolling | | finishing rolling | | | |
| No. | rolling method | heating temp. (° C) | initial thickness (mm) | total reduction (%) | temperature (° C) | reduction (%) | starting temp. (° C) | final temp. (° C) | reduction (%) | plate thickness (mm) |
| | Controlled Rolling Method | 1250 | 72 | 67 | 1150–900 | 60 | 800 | 740 | 20 | 24 |
| VII | Normalizing Method | 930 | — | — | — | — | — | — | — | 24 |
| | This | | | | | | | | | |

TABLE 8-continued

| No. | rolling method | heating temp. (° C) | initial thickness (mm) | total reduction (%) | Manufacturing Conditions: rough rolling temperature (° C) | rough rolling reduction (%) | finishing rolling starting temp. (° C) | finishing rolling final temp. (° C) | finishing rolling reduction (%) | plate thickness (mm) |
|---|---|---|---|---|---|---|---|---|---|---|
| | invention | 850 | 48 | 50 | — | — | 800 | 740 | 50 | 24 |
| | | 1250 | 120 | 67 | 1150–900 | 58 | 800 | 740 | 20 | 40 |
| VIII | " | 930 | — | — | — | — | — | — | — | 40 |
| | | 850 | 80 | 56 | — | — | 800 | 740 | 50 | 40 |
| | | 1250 | 75 | 67 | 1150–900 | 33 | 800 | 720 | 50 | 25 |
| IX | " | 920 | — | — | — | — | — | — | — | 25 |
| | | 830 | 50 | 50 | — | — | 800 | 720 | 50 | 25 |
| | | 1250 | 120 | 67 | 1150–900 | 33 | 800 | 720 | 50 | 40 |
| X | " | 920 | — | — | — | — | — | — | — | 40 |
| | | 830 | 80 | 50 | — | — | 800 | 720 | 50 | 40 |
| | | 1250 | 90 | 67 | 1150–900 | 33 | 800 | 700 | 50 | 30 |
| XI | " | 920 | — | — | — | — | — | — | — | 30 |
| | | 930 | 90 | 67 | 930–850 | 33 | 850 | 700 | 50 | 30 |

TABLE 9

| No. | rolling method | Mechanical Properties: tensile strength (kg/mm²) | yield strength (kg/mm²) | charpy appearance transition temperature (° C) |
|---|---|---|---|---|
| VII | Controlled Rolling Method | 45.6 | 30.2 | −3 |
| | Normalizing Method | 44.4 | 24.5 | −10 |
| | This invention | 46.2 | 33.5 | −35 |
| | | 52.5 | 41.8 | −6 |
| VIII | " | 45.1 | 31.0 | −28 |
| | | 49.2 | 40.7 | −74 |
| | | 62.2 | 44.7 | −42 |
| IX | " | 59.2 | 40.9 | −34 |
| | | 62.1 | 43.6 | −98 |
| | | 52.6 | 43.3 | −21 |
| X | " | 46.4 | 36.2 | −53 |
| | | 50.8 | 42.9 | −82 |
| | | 65.2 | 51.3 | −28 |
| XI | " | 49.3 | 36.7 | −45 |
| | | 60.0 | 49.4 | −82 |

The pretreatment of the steel which is preferably conducted according to the embodiment of this invention will be now explained in detail. The pretreatment comprises the steps of; initially heating the steel to a temperature higher than 1000° C; rolling the heated steel by usual rough rolling process to a steel plate of a suitable intermediate thickness; and cooling the thus rolled steel plate to a temperature lower than 650° C to thereby provide a steel plate to be processed by the rolling method of the invention described hereinbefore.

This pretreatment has been developed with a main view that the rolling method of this invention could be carried out in large scale and with an improved heat balance. This pretreatment amplifies the precipitation hardening effect. When a starting steel material containing one or more precipitation hardening element as shown in Table 1 is subjected to the pretreatment, the resulting product has a higher mechanical strength than the product which is obtained from the same starting steel material but has not been subjected to the above pretreatment.

EXAMPLE 5

Steel Samples shown in Table 10 were processed by the rolling schedules indicated in Table 11, that is, by the conventional low temperature controlled rolling method, by the basic rolling method of the invention which is referred to hereinafter as "embodiment (1) of the invention", and by the conbination of the pretreatment and the basic rolling method of the invention which is referred to hereinafter as "embodiment (2) of the invention." The mechanical properties of the resulting steel plates are shown in Table 12.

TABLE 10

| Element Contents (%) | Sample No. XII | XIII | XIV | XV | XVI | XVII | XVIII | XIX | XX |
|---|---|---|---|---|---|---|---|---|---|
| C | 0.17 | 0.15 | 0.14 | 0.11 | 0.17 | 0.15 | 0.14 | 0.14 | 0.14 |
| Si | 0.07 | 0.31 | 0.29 | 0.33 | 0.32 | 0.28 | 0.30 | 0.31 | 0.28 |
| Mn | 1.27 | 1.36 | 1.32 | 1.35 | 1.27 | 1.12 | 1.16 | 1.31 | 1.31 |
| P | 0.021 | 0.014 | 0.018 | 0.011 | 0.014 | 0.024 | 0.018 | 0.015 | 0.015 |
| S | 0.024 | 0.017 | 0.019 | 0.014 | 0.014 | 0.022 | 0.015 | 0.015 | 0.016 |
| Sol. Al | 0.001 | 0.012 | 0.022 | 0.019 | 0.032 | 0.033 | 0.018 | 0.026 | 0.031 |
| Additive element | — | — | V 0.07 | Nb 0.022 | V 0.07 Nb 0.016 | Ti 0.09 | Zr 0.04 | Nb 0.035 Mo 0.14 | Ta 0.03 |
| Remarks | semi-killed steel | killed steel | V added | Nb added | V-Nb added | Ti added | Zr added | Nb-Mo added | Ta added |

TABLE 11

| Rolling Conditions | Rolling Method | | |
|---|---|---|---|
| Primary Rolling | Conventional Controlled Rolling | Embodiment (2) of this invention | Embodiment (1) of this invention |
| initial thickness (mm) | 82 | 82 | 82 |
| Heating temperature (° C) | 1250 | 1250 | 950 |
| Rough rolling temperature (° C) | 1100 | 1100 | 950 — 850 |
| Reduction (%) | | | |
| Finish rolling starting temp. (° C) | continue ↓ 720 | continue ↓ 850 | 850 |
| final temp. (° C) | | | 750 |
| reduction (%) | (Total 87) | (Total 73) | 50 |
| Finish Plate thickness (mm) | 11 | 22 | 11 |
| colling temp. (° C) | room temperatures | 600 | room temperatures |
| cooling method | air cooling | air cooling | air cooling |
| Secondary Rolling | | | |
| Heating temperature (° C) | | continue ↓ 950 | |
| Residence time in furnace (min.) | | 8 | |
| Finish folling starting temp. (° C) | | (no rough rolling) 850 | |
| final temp. (° C) | | 750 | |
| reduction (%) | | 50 | |
| Finished Plate thickness (mm) | | 11 | |
| Cooling method | | air cooling | |

TABLE 12

| Sample No. | Rolling Method | Mechanical Properties: Tensile strength (kg/mm²) | Yield stress (kg/mm²) | Total elongation (%) | Charpy fracture appearance transition temperature (° C) |
|---|---|---|---|---|---|
| | Controlled rolling | 53.9 | 38.6 | 40.0 | −13 |
| XII | Embodiment (1) | 53.1 | 37.8 | 39.3 | −41 |
| | Embodiment (2) | 53.0 | 39.1 | 40.5 | −43 |
| | Controlled rolling | 56.1 | 41.4 | 39.5 | −45 |
| XIII | Embodiment (1) | 56.0 | 41.3 | 41.0 | −92 |
| | Embodiment (2) | 55.3 | 40.9 | 40.5 | −89 |
| | Controlled rolling | 58.5 | 48.5 | 38.5 | −56 |
| XIV | Embodiment (1) | 56.7 | 43.3 | 39.8 | −77 |
| | Embodiment (2) | 58.4 | 47.3 | 39.5 | −80 |
| | Controlled rolling | 59.5 | 44.6 | 38.0 | −72 |
| XV | Embodiment (1) | 55.5 | 39.8 | 40.1 | −95 |
| | Embodiment (2) | 57.3 | 44.8 | 39.5 | −102 |
| XVI | Controlled rolling | 65.5 | 51.8 | 34.5 | −69 |
| | Embodiment (1) | 59.7 | 45.2 | 39.0 | −112 |
| | Embodiment (2) | 61.5 | 48.8 | 38.5 | −105 |
| | Controlled rolling | 62.7 | 51.6 | 31.5 | −33 |
| XVII | Embodiment (1) | 54.9 | 43.3 | 34.5 | −68 |
| | Embodiment (2) | 58.3 | 45.1 | 35.0 | −66 |
| | Controlled rolling | 56.4 | 43.3 | 37.0 | −56 |
| XVIII | Embodiment (1) | 50.9 | 39.6 | 39.5 | −90 |
| | Embodiment (2) | 53.7 | 41.8 | 39.0 | −83 |
| | Controlled rolling | 68.8 | 55.4 | 29.0 | −56 |
| XIX | Embodiment (1) | 63.0 | 52.2 | 32.5 | −103 |
| | Embodiment (2) | 64.4 | 58.4 | 31.0 | −122 |
| | Controlled rolling | 58.7 | 45.1 | 36.2 | −51 |
| | Embodiment (1) | 57.5 | 43.2 | 37.1 | −85 |
| | Embodiment (2) | 57.5 | 43.2 | 37.1 | −85 |

Form the results shown in Table 12 it is seen that the low temperature toughness of the steel plate can be highly improved by the method of this invention and the elongation is also improved, and that especially in embodiment (2) of this invention, the improvement of the strength by the presence of the precipitation hardening element is prominent.

The reason why the function of the precipitation hardening element is more highly exerted in embodiment (2) of this invention than in embodiment(1) of this invention is construed as follows:

In the low temperature heating and rolling method, since the time required for the temperature elevation and the temperature-maintaining time are longer during the heating step before the rolling, the precipitation and agglomeration of the precipitation hardening element are allowed to advance during the heating period, and the size of the precipitate increases with the result that, it is construed, a part of the hardening function of the precipitation hardening element is lost. For this reason, it is inevitable that the strength of the product plate is a little reduced in embodiment (1) of this invention as compared with the case of the conventional controlled rolling method. However, in embodiment (2) of this invention, since either the time required for the temperature elevation or the temperature-maintaining time is very short, the agglomeration of the precipitation hardening element is small. Therefore, it is construed that the hardening function of the precipitation hardening element is hardly lost. The matter will now be specifically explained in the following example.

EXAMPLE 6

Steel plate of Steel Sample XVI shown in Table 10 were subjected to the pretreatment of; heating the steel plates to a temperature of 1250° C; rolling the heated steel plates at a starting temperature of 1100° C and a final temperature of 950° C and with a reduction in thickness of from an initial thickness of 82mm to a thickness of 22mm; and then cooling the rolled steel plates to 600° C. The thus pretreated steel plates were reheated to a temperature of 900° C and maintained at this temperature respectively for 5 minutes, 10 minutes, 15 minutes, 30 minutes and 60 minutes. Each of the heated steel plates was then finish rolled at a starting temperature of 800° C and a final temperature of 720° C and with a reduction in thickness of 50% (from 22mm to 11mm), and air-cooled to room temperature. Mechanical properties of the resulting steel plates are shown in Table 13, where those of the steel plate prepared from Steel Sample XVI by the conventional low temperature controlled rolling method under the same conditions as those in EXAMPLE 5 are also shown.

TABLE 13

| Rolling Method | Residence time in reheating step (min.) | Tensile strength (kg/mm²) | Yield stress (kg/mm²) | Total elongation (%) | Charpy fracture appearance transition temperature (° C) |
|---|---|---|---|---|---|
| Conventional low temperature rolling method | — | 65.5 | 51.8 | 34.5 | −69 |
| Embodiment (2) of this invention | 5 | 60.7 | 51.3 | 35.2 | −100 |
| Embodiment (2) of this invention | 10 | 61.2 | 49.5 | 37.5 | −98 |
| Embodiment (2) of this invention | 15 | 60.3 | 49.0 | 38.5 | −110 |
| Embodiment (2) of this invention | 30 | 59.5 | 47.0 | 39.5 | −125 |
| Embodiment (2) of this invention | 60 | 57.3 | 44.2 | 39.0 | −108 |

From the results shown in Table 13, it is seen that in accordance with the method of this invention the toughness and elongation can be highly improved while maintainingg the strength characteristics such as tensile strength and yield stress at high levels, if the residence time in the reheating step is within 30 minutes, especially 15 minutes, and that if the residence time in the reheating step is made longer than 30 minutes, the strength is considerably lowered.

EXAMPLE 7

Steel Samples shown in Table 14 were processed separately by the conventional low temperature controlled rolling method under the same condition as those in EXAMPLE 5 and by the method of embodiment (2) of the invention under the same conditions as those in EXAMPLE 6 but with a residence time of 10 minutes in heating the steels at 900° C. Mechanical properties of the resulting steel plates are shown in Table 15.

TABLE 14

| Sample No. | Element Contents (%) | | | | | |
|---|---|---|---|---|---|---|
| | C | Si | Mn | V | Nb | Sol. Al |
| XXI | 0.18 | 0.33 | 1.24 | 0.15 | — | 0.044 |
| XXII | 0.18 | 0.33 | 1.26 | 0.28 | — | 0.048 |
| XXIII | 0.17 | 0.34 | 1.26 | 0.10 | 0.014 | 0.042 |
| XXIV | 0.17 | 0.34 | 1.27 | 0.14 | 0.030 | 0.038 |

TABLE 15

| Sample No. | Rolling Method | Tensile strength (kg/mm²) | Yield stress (kg/mm²) | Total elongation (%) | Charpy fracture appearance transition temperature (° C) |
|---|---|---|---|---|---|
| | Conventional controlled rolling | 66.6 | 52.9 | 33.5 | −16 |

TABLE 15-continued

| Sample No. | Rolling Method | Tensile strength (kg/mm²) | Yield stress (kg/mm²) | Total elongation (%) | Charpy fracture appearance transition temperature (° C) |
|---|---|---|---|---|---|
| XXI | Embodiment (2) of this invention | 62.9 | 50.1 | 37.0 | −62 |
| | Conventional controlled rolling | 73.1 | 60.1 | 28.5 | +32 |
| XXII | Embodiment (2) of this invention | 69.5 | 57.8 | 31.5 | −95 |
| | Conventional controlled rolling | 67.6 | 55.8 | 30.0 | −41 |
| XXIII | Embodiment (2) of this invention | 62.2 | 51.5 | 33.5 | −105 |
| | Conventional controlled rolling | 69.7 | 57.6 | 29.0 | +6 |
| XXIV | Embodiment (2) of this invention | 64.2 | 53.7 | 32.5 | −130 |

As is seen from Table 14 and 15, when the method of this invention is applied to a steel containing 0.28% of vanadium. a tensile strength approximating 70kg/mm² can be attained by the precipitation hardening effect of vanadium without reduction of either toughness or elongation. Thus, it is readily understood that the method of this invention can give a steel plate having such a high stength as hardly is possessed by a conventional untempered steel plate, while maintaining the toughness and ductility at high levels.

However, when the starting steel material contains only the precipitation hardening element such as shown in Table 1 and its silicon and manganese contents are respectively lower than about 0.9% and about 1.8%, it is almost impossible to obtain a steel plate having a tensile stength exceeding 70kg/mm² and a yield stress exceeding 60kg/mm². As a result of our experiments, we have found that when the starting steel material contains one or more hardenability-improving elements in amounts as shown in Table 2, it is possible to provide a high strength steel plate having a tensile strength exceeding 65kg/mm² and a yield stress exceeding 60kg/mm² while maintaining an improved low temperature toughness. The upper limits of the amounts of such alloying elements shown in Table 2 are determined mainly from the economical view point and in view of the weldability of the resulting steel plate.

In the conventional as-rolled steel plate containing a large amount of alloy elements, the microscopic structure of the steel is in the phase of upper bainite which is believed to adversely affect the toughness of the steel. Notwithstanding to this, when a steel material comprising the basic composition of this invention and alloy elements shown in Table 2 in relatively large amounts is processed by the rolling method of this invention, the structure of the resulting steel plate is composed of fine ferrite, quasi pearlite and martensite substantialy without upper bainite, thus conferring a high strength to the steel plate.

The manufacture of such high strength steel plates are illustrated with reference to the following examples.

EXAMPLE 8

Ten Steel Samples prepared by melting in a 100-kg high frequency melting furnace were employed. Chemical compositions of these steels are shown in Table 16.

Each Steel Sample was shaped into a plate of 30 mm thickness, 150 mm width and 230 mm length and heated at 920° C. for 30 minutes. Then the Sample was rough rolled at temperatures of from 920° C. to 850° C. with a reduction in thickness of from 30 mm to 24 mm. The thus rough rolled steel plate was finish rolled at a starting temperature of 800° C. and a final temperature of 700° C. with a reduction in thickness of from 24 mm to 11 mm and then air-cooled to room temperature. These runs were conducted in accordance with embodiment (1) of this invention. Mechanical properties in the rolling direction of, each of the resulting steel plate are shown in Table 17.

Separately, each of Steel Samples shown in Table 16 was shaped into a plate of 82 mm thickness, 100 mm width and 100 mm length and heated at 1250° C. for 20 minutes. Then it was rough rolled at temperatures of from 1150° C. to about 950° C. with a reduction in thickness of from 82 mm to 24 mm. The thus rough rolled steel plate was cooled to about 575° C. by water projecting. Then the plate was charged into a reheating furnace and maintained at 900° C. for 30 minutes. Subsequently, the heated steel plate was finish rolled at a starting temperature of 800° C. and a final temperature of 700° C. with a reduction in thickness of from 24 mm to 11 mm, and then air cooled to room temperature. These runs were conducted in accordance with embodiment (2) of this invention. Mechanical properties in the rolling direction of each of the resulting steel plates are shown in Table 18.

The same steel plates as those in the above case of embodiment (2) of this invention were processed by the conventional controlled rolling method. Namely, each of the steel plates was heated at 1250° C. and then rough rolled at temperatures of from 1150° C. to 900° C. with a reduction in thickness of from 82 mm to 24 mm. The thus rough rolled steel plate was finish rolled at a starting temperature of 800° C. and a final temperature of 700° C. with reduction in thickness of from 24 mm to 11 mm, and then air cooled to room temperature. Mechanical properties in the rolling direction of each of the resulting steel plates are shown in Table 19.

In Tables 16 to 19, the value of the yield stress indicated by mark * is expressed in terms of the elastic limit, because of impossibility of measurement of the yield stress.

TABLE 16

| Sample No. | Additive Element | Element Contents (%) C | Si | Mn | P | S | Cr | Mo | V | Nb | B | Sol. Al |
|---|---|---|---|---|---|---|---|---|---|---|---|---|
| Comparison Steel | | | | | | | | | | | | |
| XXV | Plain C steel | 0.21 | 0.35 | 1.43 | 0.017 | 0.015 | — | — | — | — | — | 0.028 |
| XXVI | V added | 0.15 | 0.30 | 1.34 | 0.014 | 0.015 | — | — | 0.06 | — | — | 0.033 |
| Alloy Element-Incorporated Steel | | | | | | | | | | | | |
| XXVII | Mo added | 0.21 | 0.33 | 1.39 | 0.015 | 0.015 | — | 0.30 | — | — | — | 0.031 |
| XXVIII | Mo-V added | 0.15 | 0.31 | 1.39 | 0.015 | 0.015 | — | 0.16 | 0.07 | — | — | 0.032 |
| XXIX | Mo-V added | 0.15 | 0.32 | 1.38 | 0.016 | 0.015 | — | 0.62 | 0.05 | — | — | 0.029 |
| XXX | Mo-Nb added | 0.12 | 0.31 | 1.30 | 0.012 | 0.019 | — | 0.32 | — | 0.026 | — | 0.014 |
| XXXI | Mo-B-V-Nb added | 0.08 | 0.34 | 1.35 | 0.011 | 0.018 | — | 0.16 | 0.09 | 0.020 | 0.0030 | 0.032 |
| XXXII | Cr-V added | 0.15 | 0.35 | 1.39 | 0.016 | 0.020 | 1.99 | — | 0.06 | — | — | 0.031 |
| XXXIII | Mn-V-Nb added | 0.17 | 0.41 | 2.26 | 0.012 | 0.015 | — | — | 0.06 | 0.05 | — | 0.032 |
| XXXIV | Si-V added | 0.20 | 0.95 | 1.31 | 0.017 | 0.020 | — | — | 0.08 | — | — | 0.033 |

TABLE 17

| Sample No. | Steel System | Embodiment (1) of this Invention: Tensile strength (kg/mm²) | Yield stress (kg/mm²) | Total elongation (%) | Impact absorbed energy transition temperature (° C) | Impact absorbed energy (kg-m) 0° C | −60° C |
|---|---|---|---|---|---|---|---|
| XXV | Plain C steel | 56.7 | 42.3 | 35 | −52 | 24.3 | 8.3 |
| XXVI | V added | 54.8 | 46.7 | 36 | −80 | 22.1 | 20.6 |
| XXVII | Mo added | 82.2 | 62.1* | 24 | −42 | 15.7 | 3.3 |
| XXVIII | Mo-V added | 67.7 | 54.6 | 28 | −90 | 15.7 | 13.8 |
| XXIX | Mo-V added | 103.9 | 72.1* | 23 | −82 | 10.9 | 8.9 |
| XXX | Mo-Nb added | 71.3 | 62.5 | 28 | −137 | 15.3 | 12.2 |
| XXXI | Mo-B-V-Nb added | 73.1 | 53.2* | 29 | −91 | 11.4 | 10.8 |
| XXXII | Cr-V added | 93.6 | 70.2* | 22 | −98 | 8.3 | 6.8 |
| XXXIII | Mn-V-Nb added | 96.3 | 67.3* | 23 | −68 | 7.7 | 5.3 |
| XXXIV | Si-V added | 70.5 | 56.8 | 28 | −77 | 13.5 | 11.8 |

TABLE 18

| Steel No. | Steel System | Embodiment (2) of this Invention: Tensile strength (kg/mm²) | Yield stress (kg/mm²) | Total elongation (%) | Impact absorbed energy transition temperature (° C) | Impact absorbed energy (kg-m) 0° C | −60° C |
|---|---|---|---|---|---|---|---|
| XXV | Plain C steel | 59.1 | 42.6 | 36.0 | −50 | 16.9 | 4.5 |
| XXVI | V added | 57.3 | 49.8 | 34.0 | −90 | 21.6 | 12.4 |
| XXVII | Mo added | 75.0 | 54.9* | 24.0 | −44 | 6.5 | 4.0 |
| XXVIII | Mo-V added | 70.1 | 58.8* | 27.0 | −111 | 14.2 | 9.7 |
| XXIX | Mo-V added | 108.6 | 76.5* | 20.0 | −157 | 5.5 | 4.9 |
| XXX | Mo-Nb added | 91.4 | 75.2* | 22.5 | −124 | 6.5 | 6.3 |
| XXXI | Mo-B-V-Nb added | 82.9 | 60.7* | 23.5 | −145 | 8.1 | 7.4 |
| XXXII | Cr-V added | 98.1 | 70.3* | 20.5 | −140 | 7.5 | 6.2 |
| XXXIII | Mn-V-Nb added | 89.3 | 66.4* | 20.5 | −80 | 6.4 | 4.9 |
| XXXIV | Si-V added | 71.2 | 58.8 | 29.5 | −81 | 12.0 | 10.4 |

TABLE 19

| Sample No. | Steel System | Conventional Controlled Rolling Method: Tensile strength (kg/mm²) | Yield stress (kg/mm²) | Total elongation (%) | Impact absorbed energy transition temperature (° C) | Impact absorbed energy (kg-m) 0° C | −60° C |
|---|---|---|---|---|---|---|---|
| XXV | Plain C steel | 58.7 | 42.0 | 36.0 | −44 | 15.3 | 4.3 |
| XXVI | V added | 61.8 | 50.3 | 27.0 | −48 | 20.0 | 1.4 |
| XXVII | Mo added | 76.5 | 55.1* | 21.0 | −14 | 6.8 | 1.4 |
| XXVIII | Mo-V added | 67.5 | 48.8* | 27.0 | −28 | 11.0 | 1.2 |
| XXIX | Mo-V added | 82.8 | 58.9* | 21.0 | +4 | 3.4 | 1.0 |

TABLE 19-continued

| Sample No. | Steel System | Conventional Controlled Rolling Method: Tensile strength (kg/mm²) | Yield stress (kg/mm²) | Total elongation (%) | Impact absorbed energy transition temperature (° C) | Impact absorbed energy (kg-m) 0° C | −60° C |
|---|---|---|---|---|---|---|---|
| XXX | Mo-Nb added | 84.7 | 63.1* | 20.0 | −20 | 3.9 | 1.1 |
| XXXI | Mo-B-V-Nb added | 80.6 | 54.4* | 20.0 | +7 | 2.2 | 0.9 |
| XXXII | Cr-V added | 109.5 | 87.2* | 19.0 | −42 | 7.2 | 0.8 |
| XXXIII | Mn-V-Nb added | 91.4 | 55.4* | 23.0 | −20 | 3.9 | 0.6 |
| XXXIV | Si-V added | 67.9 | 51.7 | 38.5 | −35 | 19.7 | 1.8 |

From the results shown in Tables 17, 18 and 19, it is evident that a prominent improvement in toughness is attained according to this invention. In the steel product obtained by the conventional rolling method, there is observed a tendency that the toughness becomes poor with the increase of the strength, particularly in the case of steel plates having 60 kg/mm² or more. This may be readily confirmed by the results in Table 19 wherein an elevation of the transition temperature or reduction of the impact absorbed energy becomes conspicuous with the increase of the strength. However, in the steel product produced by the method of this invention, elevation of the transistion temperature, if observed, is negligible and reduction of the impact absorbed energy is slight to such an extent that it is tolerable as a natural outcome of the increase of the strength. Thus, according to this invention, there is provided a high strength steel plate having a sufficient toughness.

In Example 8, the effect of this invention has been explained specifically with respect to the steel plates of a final thickness of 11 mm. Even in the case of steel plates of a greater thickness, the method of this invention is advantageous over the conventional tempering or normalizing method in that the mechanical properties of plates are not so degrated with the increase of the plate thickness as in the conventional tempering or normalizing method. In the case of steel plates of a thickness of 30 mm or 40 mm, improvement in strength and toughness can be attained in accordance with this invention only by incorporating alloy elements in some amount.

However, as is seen from the results of Tables 17 and 18, the strong and tough steel plate of this invention is a little inferior with respect to the ductibility to the conventional tempered steel plate or the like. In order to overcome this defect, we propose to temper the rolled steel plate at a temperature of from 500° to 650° C. for a time duration of from 20 minutes to 2 hours in a customary manner such as adopted in the conventional quenching and tempering methods. By this tempering process, the ductility appreciable in terms of values of the total elongation and impact absorbed energy is improved to a degree favorably comparable to the conventional quench tempered steel, through the tensile strength is reduced slightly. Thus, there is provided a steel plate having highly improved strength, toughness and ductility in combination by subjecting the steel plate manufactured according to this invention, to the tempering process.

The reasons why the tempering temperature is limited to the range of from 500° to 650° C. and the tempering time is limited to from 20 minutes to 2 hours are as follows:

The tempering process is conducted for the purpose of recovering the ductility of the as-rolled steel plate. When the tempering temperature is below 500° C., the recovery of the ductility is insufficient, and when the tempering temperature exceeds 650° C., the strength is lowered. In case the tempering time is shorter than 20 minutes, the recovery of the ductility is insufficient. On the other hand, the tempering time exceeding 2 hours does not give any particular effect. Thus, from the economical viewpoint it is not preferred to prolong the tempering time beyond 2 hours.

EXAMPLE 9

Steel Sample XXXV of the following composition prepared melting in a 100-kg high frequency melting furnace was used in this Example.

| Chemical Composition of Steel Sample XXXV | |
|---|---|
| Carbon | 0.16% |
| Silicon | 0.31% |
| Manganese | 1.35% |
| Vanadium | 0.06% |
| Molybdenum | 0.30% |
| Sol. aluminum | 0.030% |

Steel Sample XXXV was shaped into a plate of 58 mm thickness. 82 mm width and 140 mm length. Then, each of the steel plates was heated at a temperature of 900° C. for 30 minutes and rough rolled at temperatures of from 900° to 850° C. with a reduction in thickness of from 58 mm to 40 mm. The thus rough rolled steel plate was finish rolled at a starting temperature of 850° C. and a final temperature of 700° C. with a reduction in thickness of from 40mm to 11 mm, and then air cooled to room temperature. Subsequently, the as-rolled steel plate was heated and maintained at 500° C., 600° C. or 650° C. for 1 hour, followed by air-cooling. Mechanical properties in the rolling direction of the as-rolled steel plate and the tempered steel plates are shown in Table 20.

Table 20

| Tempering Conditions | Tensile strength (kg/mm²) | Yield stress (kg/mm²) | Total elongation (%) | Fracture appearance transition temperature (° C) | Impact absorbed energy (kg-m) 0° C | −60° C |
|---|---|---|---|---|---|---|
| Untempered | | | | | | |

Table 20-continued

| Tempering Conditions | Tensile strength (kg/mm²) | Yield stress (kg/mm²) | Total elongation (%) | Fracture appearance transition temperature (° C) | Impact absorbed energy (kg-m) 0° C | Impact absorbed energy (kg-m) −60° C |
|---|---|---|---|---|---|---|
| as-rolled plate | 85.3 | 58.0 | 22.0 | −153 | 10.1 | 8.1 |
| 500° C × 1 hour and air-cooling | 72.9 | 63.3 | 26.0 | −157 | 14.8 | 12.6 |
| 600° C × 1 hour and air-cooling | 69.9 | 64.7 | 27.5 | −142 | 16.2 | 12.8 |
| 650° C × 1 hour and air-cooling | 65.5 | 60.7 | 30.5 | −142 | 17.9 | 12.8 |

From the results shown in Table 20, it is seen that when the steel material of the above composition is rolled and subsequently tempered according to this invention, there is provided a steel plate having excellent strength, toughness and ductility, namely, a tensile strength of higher than 65 kg/mm², a yield stress of higher than 60 kg/mm², a brittle-ductile transition temperature of lower than −60° C., a total elongation of more than 26% and an impact absorbed energy at 0° C. of more than 14 kg-m.

When corrosion resistance, weathering resistance, resistance to marine corrosion or the like is required, the starting steel material may incorporate one or more of nickel (0.2 – 2.0%), chromium (0.2 – 3.0%), copper (0.2 – 1.0%) and other elements.

The manufacture of steel plates having such resistances will illustrated in the following Examples.

EXAMPLE 10

Stell Samples XXXVI to XXXIX shown in Table 21 were used in this Example. Each of Steel Samples was shaped into a plate of 82 mm thickness, 100 mm width and 260 mm length. Then, it was heated and maintained at 1250° C. for 20 minutes, and subjected to the primary rolling in which a reduction in thickness of from 82 mm to 30 mm was effected within a temperature range of from 1100° to 900° C. The thus rolled steel plate was cooled to a temperature below 650° C. by water-projecting and the cooled steel plate was immediately reheated at 900° C. for 20 seconds, following which it was subjected to the secondary rolling. The secondary rolling consisted of a rough rolling at temperatures of from 900° to 850° C. and with a reduction in thickness of from 30 mm to 24 mm, and a finish rolling at temperatures of from 800° to 700° C. ( i.e. a starting temperature of 800° C. and a final temperature of 700° C. ) and with a reduction in thickness of from 24 mm to 11 mm. The thus finish rolled steel plate was air cooled to room temperature. Mechanical poperties in the rolling direction of each of the resulting steel plates are shown in Table 22.

From the results shown in Table 225 it is seen that when the starting steel material is incorporated with the alloy elements for improving corrosion resistance, weathering resistance and marine resistance, such as nickel, chromium and copper, the steel plate manufactured by the method of this invention maintains excellent strength and toughness.

TABLE 21

| Chemical Composition (% by weight) | Sample No. XXXVI | XXXVII | XXXVIII | XXXIX |
|---|---|---|---|---|
| Carbon | 0.16 | 0.14 | 0.13 | 0.15 |
| Silicon | 0.26 | 0.33 | 0.28 | 0.29 |
| Manganese | 1.35 | 1.32 | 1.22 | 1.22 |
| Phosphorus | 0.016 | 0.014 | 0.017 | 0.012 |
| Sulfur | 0.014 | 0.014 | 0.018 | 0.014 |
| Molybdenum | 0.06 | 0.13 | 0.12 | 0.31 |
| Vanadium | 0.04 | 0.06 | 0.04 | 0.05 |
| Copper | 0.30 | 0.28 | — | — |
| Nickel | 0.35 | — | — | 0.55 |
| Chromium | 0.41 | — | 1.03 | — |

TABLE 22

| Sample No. | Additive Elements | Tensile strength (kg/mm²) | Yield stress (kg/mm²) | Total elongation (%) | Fracture appearance transition temperature (° C) | Impact absorbed energy (kg-m) 0° C | Impact absorbed energy (kg-m) −60° C |
|---|---|---|---|---|---|---|---|
| XXXVI | Cu-Ni-Cr | 63.0 | 51.8 | 34.0 | −92 | 20.2 | 17.3 |
| XXXVII | Cu | 69.7 | 58.1 (elastic limit) | 28.2 | −88 | 14.1 | 11.5 |
| XXXVIII | Cr | 68.3 | 50.3 | 27.2 | −77 | 15.5 | 10.0 |
| XXXIX | Ni | 84.3 | 66.2 (elastic limit) | 21.0 | −99 | 9.8 | 7.8 |

There have been usually employed normalized or quench tempered steel plates as structural steel plates for service at low temperatures, such as the material for pipe line or storage tank for liquid gas and the like. notwithstanding without normalizing or quench-tempering process, this invention provides a steel plate having excellent fracture toughness and other mechanical properties enough to be favorably employed as the low temperature structural steel plate. In accordance with this invention, in order to manufacture such steel plate, nickel in an amount of from 0.5 to 5.0% is incorporated to the starting steel material. When the nickel content is less than 0.5%, the resulting steel plate has not the toughness required for the low temperature structural steel plate. On the other hand, a nickel content of larger than 5% degrades the weldability of the steel plate, and the addition of nickel in such high amount is uneconomical because nickel is expensive element.

The manufacture of the low temperature structural steel plate containing nickel will be illustrated in the following Example.

EXAMPLE 11

Eleven Steel Samples prepared by melting in a 100-kg high frequency melting furnace were employed. Chemical compositions of these steels are shown in Table 23.

Each of Steel Samples was shaped into a plate of 80 mm thickness, 80 mm width and 250 mm length and heated at 930° C. for 20 minutes. Then, the heated steel plate was rough rolled within a temperature range of from 930° to 850° C. and with a reduction in thickness of from 80 mm to 60 mm, and finish rolled at a starting temperature of 800° C. and a final temperature of 700° C. with a reduction in thickness of from 60 mm to 30 mm. The finish rolled steel plate was air cooled to room temperature. Mechanical properties in the rolling direction of each of the resulting plates are shown in Table 24 These runs were conducted in accordance with embodiment (1) of this invention.

Separately, each of Steel Samples shown in Table 23 was shaped into a plate of 150 mm thickness, 80 mm width and 100 mm length and heated at 1250° C. for 20 minutes. Then it was subjected to the primary rolling in which rolling was continuously conducted at temperatures of from 1150° to about 950° C. to form a plate of 120 mm thickness, 80 mm width and 170 mm length. Then the plate was cooled by water- projecting cooling to a temperature below 650° C. following which the plate was charged into a reheating furnace and maintained at 930° C. for 20 minutes. Then the reheated steel plate was subjected to the secondary rolling. In the secondary rolling, the steel plate was rough rolled at temperatures of from 930° to 850° C. with a reduction in thickness of from 120 mm to 60 mm and finish rolled at a starting temperature of 800° C. and a final temperature of 700° C. with a reduction in thickness of from 60 mm to 30 mm. The finish rolled steel plate was cooled to room temperature by air cooling. Mechanical properties in the rolling direction of each of the resulting steel plates are shown in Table 25. Low temperature toughness was determined in terms of the values of the Charpy fracture appearance transition temperature and the fracture appearance transition temperature in Drop Weight Tearing Test. As shown in the following results, the steel plates containing nickel in an amount of from 0.6 to 5.0% according to embodiment (1) and (2) of this invention exhit a Charpy transition temperature lower than −130° C. and a fracture appearance transition temperature in Drop Weight Tearing Test of lower than −100° C.

Table 23

| Sample No | Nickel Content % | Element Content (%) C | Si | Mn | P | S | Ni | Mo | V | Nb | SOL. Al |
|---|---|---|---|---|---|---|---|---|---|---|---|
| Comparison Steel | | | | | | | | | | | |
| XXXX | 0 | 0.06 | 0.31 | 1.56 | 0.002 | 0.005 | 0.01 | 0.15 | 0.08 | 0.017 | 0.026 |
| XXXXI | 0.4 | 0.06 | 0.33 | 1.47 | 0.002 | 0.005 | 0.41 | 0.15 | 0.09 | 0.019 | 0.029 |
| XXXXII | 8.0 | 0.06 | 0.33 | 1.55 | 0.003 | 0.005 | 8.1 | 0.15 | 0.08 | 0.020 | 0.028 |
| Nickel incorporated steel | | | | | | | | | | | |
| XXXXIII | 0.8 | 0.06 | 0.34 | 1.47 | 0.002 | 0.005 | 0.83 | 0.15 | 0.08 | 0.018 | 0.028 |
| XXXXIV | 1.4 | 0.06 | 0.35 | 1.49 | 0.003 | 0.005 | 1.41 | 0.14 | 0.08 | 0.020 | 0.030 |
| XXXXV | 2.5 | 0.06 | 0.32 | 1.48 | 0.002 | 0.005 | 2.43 | 0.16 | 0.09 | 0.020 | 0.027 |
| XXXXVI | 5.0 | 0.06 | 0.31 | 1.49 | 0.003 | 0.005 | 5.00 | 0.17 | 0.08 | 0.018 | 0.031 |
| XXXXVII | 0.8 | 0.06 | 0.31 | 1.74 | 0.003 | 0.005 | 0.80 | — | 0.08 | 0.021 | 0.027 |
| XXXXVIII | 0.6 | 0.10 | 0.35 | 1.39 | 0.002 | 0.005 | 0.60 | — | — | 0.020 | 0.034 |
| XXXXIX | 0.6 | 0.13 | 0.35 | 1.43 | 0.002 | 0.005 | 0.61 | — | — | 0.010 | 0.032 |
| XXXXX | 1.0 | 0.10 | 0.33 | 1.41 | 0.003 | 0.005 | 1.08 | — | — | — | 0.024 |

Table 24

| Sample No. | Steel System | Tensile Strength (Kg/mm²) | Yield Strength (Kg/mm²) | Total Elongation (%) | Charpy Fracture Appearance Transition Temperature (° C) | DWTT FATT (r) |
|---|---|---|---|---|---|---|
| | Embodiment (1) of this Invention | | | | | |
| XXXX | Mo-V-Nb | 55.6 | 49.8 | 36 | −100 | −82 |
| XXXXI | Mo-V-Nb- 0.4 Ni | 54.3 | 46.1 | 36 | −110 | −96 |
| XXXXII | Mo-V-Nb- 8 Ni | 102.1 | 69.3 | 19 | −160 | −97 |
| XXXXIII | Mo-V-Nb- 0.8 Ni | 57.3 | 41.6 | 40 | −128 | −101 |
| XXXXIV | Mo-V-Nb- 1.4 Ni | 66.0 | 43.0 | 36 | −160 | −116 |
| XXXXV | Mo-V-Nb- 2.5 Ni | 74.2 | 52.7 | 31 | −140 | −105 |
| XXXXVI | Mo-V-Nb- 5.° Ni | 88.7 | 60.5 | 27 | −183 | −99 |
| XXXXVII | V-Nb- 0.8 Ni | 56.2 | 46.9 | 42 | −147 | −105 |
| XXXXVIII | Nb- 0.6 Ni | 50.8 | 41.6 | 44 | −140 | −103 |
| XXXXIX | Nb- 0.6 Ni | 59.3 | 41.3 | 39 | 21 −160 | −123 |
| XXXXX | 1 Ni | 51.8 | 42.3 | 42 | −153 | −125 |

Table 25

| Sample No. | Steel System | Tensile Strength (Kg/mn²) | Yield Strength (Kg/mn²) | Total Elongation (%) | Charpy Fracture Appearance Transition Temperature (° C) | DWTT FATT (r) |
|---|---|---|---|---|---|---|
| | Embodiment (2) of this Invention | | | | | |
| XXXX | Mo-V-Nb | 54.1 | 43.2 | 44 | −111 | −85 |
| XXXXI | Mo-V-Nb- 0.4 Ni | 54.5 | 45.2 | 43 | −135 | −93 |
| XXXXII | Mo-V-Nb- 8 Ni | 115.4 | 72.5 | 17 | <−160 | −107 |
| XXXXIII | Mo-V-Nb- 0.8 Ni | 56.5 | 47.3 | 39 | −176 | −113 |
| XXXXIV | Mo-V-Nb- 1.4 Ni | 65.2 | 44.8 | 38 | −220 | −135 |
| XXXXV | Mo-V-Nb- 2.5 Ni | 77.6 | 60.5 | 31 | −199 | −130 |
| XXXXVI | Mo-V-Nb- 5 Ni | 91.2 | 66.4 | 27 | −208 | −133 |
| XXXXVII | V-Nb- 0.8 Ni | 55.9 | 47.7 | 42 | <−160 | −119 |
| XXXXVIII | Nb- 0.6 Ni | 51.3 | 42.6 | 43 | <−160 | −131 |
| XXXXIX | Nb- 0.6 Ni | 54.7 | 45.2 | 42 | −145 | −118 |
| XXXXX | 1 Ni | 53.1 | 43.3 | 39 | <−160 | −133 |

We claim:

1. A method for the manufacture of a high strength and tough steel plate from a steel comprising 0.03 – 0.30% of carbon, not more than 1.5% of silicon, 0.5 – 4.0% of manganese and the balance essentially of iron, the method comprising the steps of; applying a primary rolling step by heating the steel to a temperature higher than 1000° C; rough rolling the heated steel to obtain a steel plate of a suitable intermediate thickness; cooling down the rough rolled steel plate to a temperature lower than 650° C; reheating the cooled steel plate to a temperature of 800° to 1000° C; and applying a secondary rolling step by finish rolling the reheated steel plate within the range of temperature of from 680° to 850° C and with the total reduction in thickness of not less than 30% on the basis of the steel plate thickness when said finishing rolling is started.

2. A method as claimed in claim 1, wherein the steel further contains at least one element selected from the group consisting of 0.02 – 0.30% of vanadium 0.05 – 1.0% of molybdenum, 0.005 – 0.20% of niobium, 0.03 – 0.20% of titanium, 0.02 – 0.20% of zirconium and 0.01 – 0.10% of tantalum.

3. A method as claimed in claim 2, wherein the steel further contains at least one element selected from the group consisting of 0.2 – 3.0% of chromium and 0.002 – 0.01% of boron.

4. A method as claimed in claim 3, wherein the steel further contains at least one element selected from the group consisting of 0.2 – 1.0% of copper, 0.2 – 2.0% of nickel.

5. A method as claimed in claim 2, wherein the steel further contains at least one element selected from the group consisting of 0.2 – 1.0% of copper, 0.2 – 2.0% of nickel.

6. A method as claimed in claim 2, wherein the steel further contains 0.6 – 5.0% of nickel.

7. A method as claimed in claim 2, wherein the steel further contains at least one element selected from the group consisting of 0.2 – 3.0% of chromium and 0.002 – 0.01% of boron.

8. A method as claimed in claim 1, wherein the steel further contains at least one element selected from the group consisting of 0.2 – 1.0% of copper, 0.2 – 2.0% of nickel.

9. A method as claimed in claim 1, wherein the steel further contains at least one element selected from the group consisting of 0.2 – 1.0% of copper, 0.2 – 2.0% of nickel.

10. A method as claimed in claim 1, wherein the steel further contains 0.6 – 5.0% of nickel.

11. A process as claimed in claim 1, further comprising the step of tempering the finish rolled steel plate at a temperature ranging from 500° C to 650° C for a time duration ranging from 20 minutes to 2 hours.

12. The process according to claim 1 wherein the cooled steel plate is reheated to a temperature of 800°–950° C prior to finish rolling.

13. The process according to claim 1 wherein the finish rolling is carried out within the temperature range of 680° –800° C.

14. A method for the manufacture of a high strength an tough steel plate from a steel comprising 0.03 – 0.30% of carbon, not more than 1.5% of silicon. 0.5 – 4.0% of manganese and the balance essentially of iron, the method comprising the steps of; applying a primary rolling step by heating the steel to a temperature higher than 1000° C; rough rolling the heated steel to obtain a steel plate of a suitable intermediate thickness; cooling down the rough rolled steel plate to a temperature lower than 650° C; reheating the cooled steel to a temperature of 800° to 1000° C; and applying a secondary rolling step by finish rolling the reheated steel plate by several passes through rolling mill, each pass in said finish rolling being conducted within the temperature range of 680° to 850°. and the total reduction in thickness during the finish rolling passes being not less than 30% on the basis of the steel plate thickness when said finish rolling is started.

* * * * *